US012234698B2

(12) United States Patent
Aldosary et al.

(10) Patent No.: US 12,234,698 B2
(45) Date of Patent: Feb. 25, 2025

(54) EXPANDABLE RETRIEVABLE PLUG AND METHODS OF USE

(71) Applicant: SAUDI ARABIAN OIL COMPANY, Dhahran (SA)

(72) Inventors: Shabib F. Aldosary, Riyadh (SA); Khaled M. Mutairi, Riyadh (SA); Abdulrahman Ali Alsultan, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 30 days.

(21) Appl. No.: 18/153,842

(22) Filed: Jan. 12, 2023

(65) Prior Publication Data

US 2024/0240534 A1 Jul. 18, 2024

(51) Int. Cl.
*E21B 23/04* (2006.01)
*E21B 31/18* (2006.01)
*E21B 33/12* (2006.01)

(52) U.S. Cl.
CPC ..... *E21B 23/0416* (2020.05); *E21B 31/18* (2013.01); *E21B 33/1208* (2013.01)

(58) Field of Classification Search
CPC .. E21B 23/0416; E21B 23/0411; E21B 31/18; E21B 31/12; E21B 33/12; E21B 33/1208
See application file for complete search history.

(56) References Cited

U.S. PATENT DOCUMENTS 5,316,081 A * 5/1994 Baski ..... E21B 33/127 166/188
2009/0308592 A1* 12/2009 Mercer ..... E21B 33/1208 166/134
2011/0073310 A1* 3/2011 Clemens ..... E21B 23/06 166/135
2022/0136358 A1* 5/2022 Mitchell ..... E21B 33/128 166/387

FOREIGN PATENT DOCUMENTS

GB 2599699 A * 4/2022 ..... B33Y 50/00

* cited by examiner

*Primary Examiner* — Caroline N Butcher
(74) *Attorney, Agent, or Firm* — Vorys, Sater, Seymour and Pease LLP

(57) ABSTRACT

An expandable, retrievable plug includes a base, a plurality of arm bars pivotably attached to the base and movable between stowed and extended configurations, and a set of expandable blades operatively coupled to and angularly interposing each pair of angularly adjacent arm bars such that, as the plurality of arm bars move to the extended configuration, each set of expandable blades transitions from a stacked state to a fanned state. An inflatable element is attached to the base and is engageable with the plurality of arm bars, and an expandable seal is mounted to the plurality of arm bars and each set of expandable blades. Selectively inflating the inflatable element transitions the plurality of arm bars from the stowed configuration to the extended configuration, which transitions each set of expandable blades from the stacked state to the fanned state, and simultaneously radially expands the expandable seal.

20 Claims, 5 Drawing Sheets

EXPANDABLE RETRIEVABLE PLUG AND METHODS OF USE

FIELD OF THE DISCLOSURE

The present disclosure relates generally to downhole isolation of wellbores and, more particularly, to retrievable plugs for use in variously-sized wellbores.

BACKGROUND OF THE DISCLOSURE

During hydrocarbon extraction operations in a drilled wellbore, the need often arises to isolate some portion of the wellbore to undertake certain activities, such as hydraulic fracturing, within only specific locations within the wellbore. In these scenarios, a plug can be deployed and set downhole to isolate portions of the wellbore. Some plugs are retrievable from the wellbore, while others are intended to be permanently set, such as during plug and abandon operations. Retrievable plugs can be set downhole using wireline, slickline, or coiled tubing and can temporarily isolate portions of the wellbore. Once the operation is completed, the plug can be retrieved by deactivating or reversing the actuation mechanism. In alternate examples, however, the plug may require a drilling operation to remove the temporary plug via milling.

Plugs are commonly set using wireline, slickline, or coiled tubing downhole, but the energy required to properly set a plug may require additional hydraulic setting tooling or large amounts of electricity. Further, based upon the diameter of the wellbore, or any inserted casings or tubing, specialized plugs may be required to generate a seal at the prescribed diameter. As such, development and installation costs may increase for wellbores which use alternative diameter equipment or those with variable downhole geometry.

In an effort to reduce the time and cost associated with wellbore sealing operations, a reusable plug with variable diameter and reduced installation requirements is desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, an expandable, retrievable plug includes a base, a plurality of arm bars pivotably attached to the base and movable between stowed and extended configurations, a set of expandable blades operatively coupled to and angularly interposing each pair of angularly adjacent arm bars such that, as the plurality of arm bars move to the extended configuration, each set of expandable blades transitions from a stacked state to a fanned state, an inflatable element attached to the base and engageable with the plurality of arm bars, and an expandable seal mounted to the plurality of arm bars and each set of expandable blades. Selectively inflating the inflatable element transitions the plurality of arm bars from the stowed configuration to the extended configuration, which transitions each set of expandable blades from the stacked state to the fanned state, and simultaneously radially expands the expandable seal.

In a further embodiment, a method includes conveying a plug into a wellbore on a conveyance, wherein the plug includes a base, a plurality of arm bars pivotably attached to the base, a set of expandable blades operatively coupled to and angularly interposing each pair of angularly adjacent arm bars of the plurality of arm bars, an inflatable element attached to the base and engageable with the plurality of arm bars, and an expandable seal mounted to the plurality of arm bars and each set of expandable blades. The method further includes inflating the inflatable element and thereby urging the plurality of arm bars to move from a stowed configuration toward an extended configuration, transitioning each set of expandable blades from a stacked state to a fanned state as the plurality of arm bars move to the extended configuration, radially expanding the expandable seal as the plurality of arm bars move to the extended configuration and each set of expandable blades transitions to the fanned state, and sealingly engaging an inner wall of the wellbore with the expandable seal as the expandable seal radially expands.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1A:
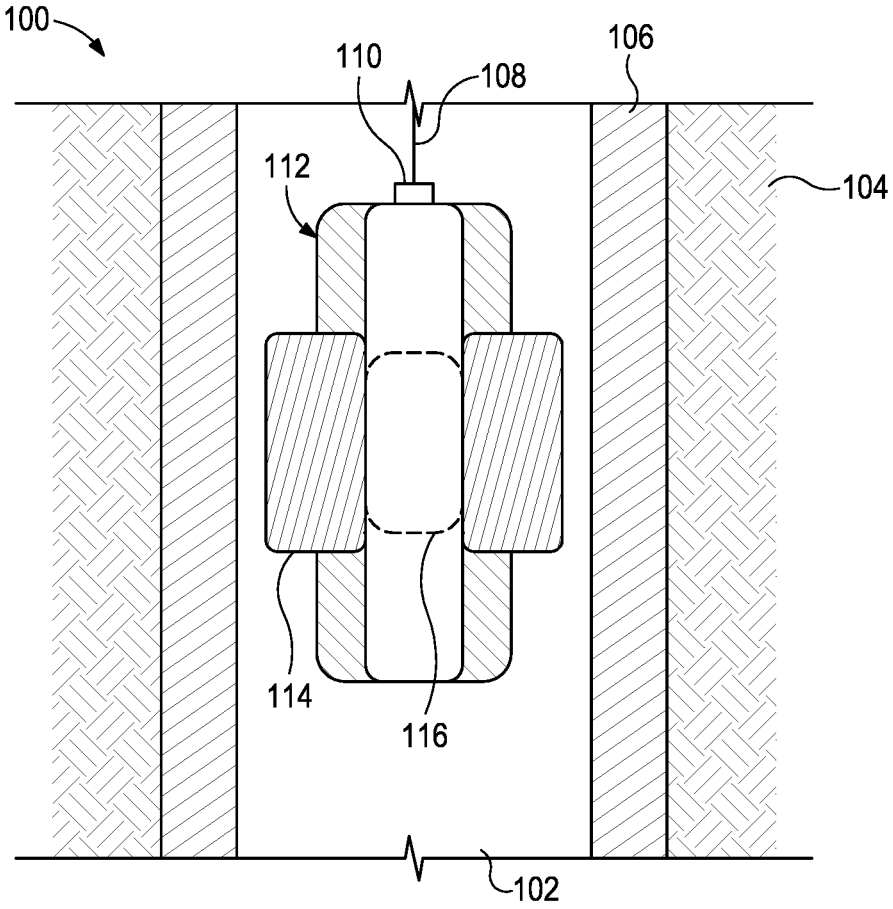
FIG. 1A (PRIOR ART)
FIGS. 1A and 1B are example cross-sectional side views of a prior art plug.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to the downhole isolation of wellbores and, more particularly, to retrievable plugs for use in wellbores exhibiting a range of sizes (diameters). The plugs or "bridge plugs" described herein may be deployed in a wellbore, casing, or tubing and are fully retrievable and reusable. Further, the methods of installation, utilization, and retrieval of the plugs are also disclosed herein to illustrate the advantages presented by the disclosed embodiments, such as a reduced energy requirement and elimination of specialized tooling required for installation.

FIG. 1A is a cross-sectional side view of a prior art plug 100. The plug 100 is shown in FIG. 1A a first or "unactuated" state. The plug 100 is depicted as being lowered into a wellbore 102 drilled into a subterranean formation 104. In some cases, the wellbore 102 may be lined with a string of casing 106, but the casing 106 could alternatively be omitted and the plug 100 may be deployed in an "open-hole" wellbore. The plug 100 can be lowered into the wellbore 102 on a conveyance 108, which can include wireline, slickline, coiled tubing, drill pipe, production tubing, or any combination thereof. Those skilled in the art will readily recognize that the type of conveyance 108 utilized may depend upon the actuation mechanism required by the plug 100. The conveyance 108 may be operatively coupled to the plug 100 via a top connector 110, which in some cases may comprise a setting fish neck. The plug 100 is conveyed into the wellbore 102 to a predetermined location and actuated to isolate downhole portions of the wellbore 102 from uphole portions.

The plug 100 may include a generally cylindrical body 112 sized to be received within and lowered into the wellbore 102. One or more seal elements 114 are arranged or provided on the body 112 and are actuatable to create a seal within the wellbore 102 as the plug 100 actuates. Actuating the plug 100 to expand the seal elements 114 may be facilitated via a variety of expansion devices or mechanisms 116, shown generally in FIG. 1A in dashed lines. In the illustrated example, the expansion mechanism 116 comprises an inflatable device operable to hydraulically or pneumatically expand the seal elements 114 into sealing contact with the inner wall of the wellbore 102 or the casing 106. In alternative examples, the expansion mechanism 116 may comprise interacting mechanical components configured to axially compress the seal elements 114, which causes the seal elements 114 to expand radially outward and into sealing contact with the inner wall of the wellbore 102 or the casing 106.

Figure 1B:
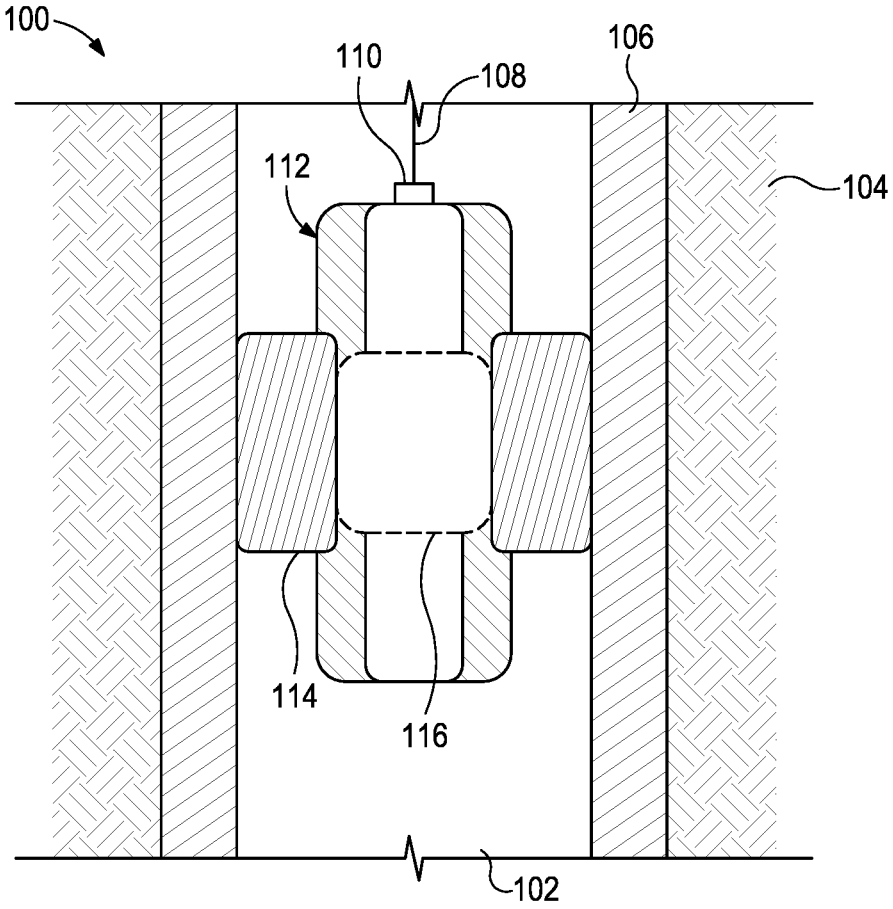
FIG. 1B (PRIOR ART)

FIG. 1B is a cross-sectional side view of the prior art plug 100 in a second or "actuated" state. In FIG. 1B, the expansion mechanism 116 has been activated or actuated to expand or force the seal elements 114 into sealing contact with the inner wall of the wellbore 102 or the casing 106. The seal elements 114 are thereby capable of fluidly isolating portions of the wellbore 102 above and below the actuated plug 100. The actuated plug 100 may then facilitate hydrocarbon extraction operations within either isolated portion of the wellbore 102, and may be retained in place permanently or later retrieved.

Prior art plugs, such as the plug 100, are conventionally designed and sized to operate in wellbores of a predetermined size (diameter). Accordingly, larger diameter wellbores will require plugs sized to seal the larger diameter, and smaller diameter wellbores will require plugs sized to seal the smaller diameter. Further, removing the plug 100 oftentimes requires a drilling or milling operation to physically destroy the plug 100 downhole, or may alternatively require additional downhole tooling and mechanisms designed to reverse or deactivate the expansion mechanism 116. In either removal scenario, the plug 100 may be damaged or unusable in further downhole sealing operations.

According to the present disclosure, embodiments of an expandable and retrievable plug are described. The expandable and retrievable plug includes an inflatable element operable to be inflated and thereby transition a plurality of arm bars and expandable blades radially outward. As the arm bars and expandable blades expand radially outward, an expandable seal correspondingly expands radially outward to sealingly engage an inner diameter of the wellbore where the plug is deployed. The radially outward movement of the arms and blades allows the expandable seal to seal against a wide range of wellbore diameters. Moreover, actuation of the plug is reversible, which allows the plug to be deactivated and retrieved back to surface.

Figure 2:
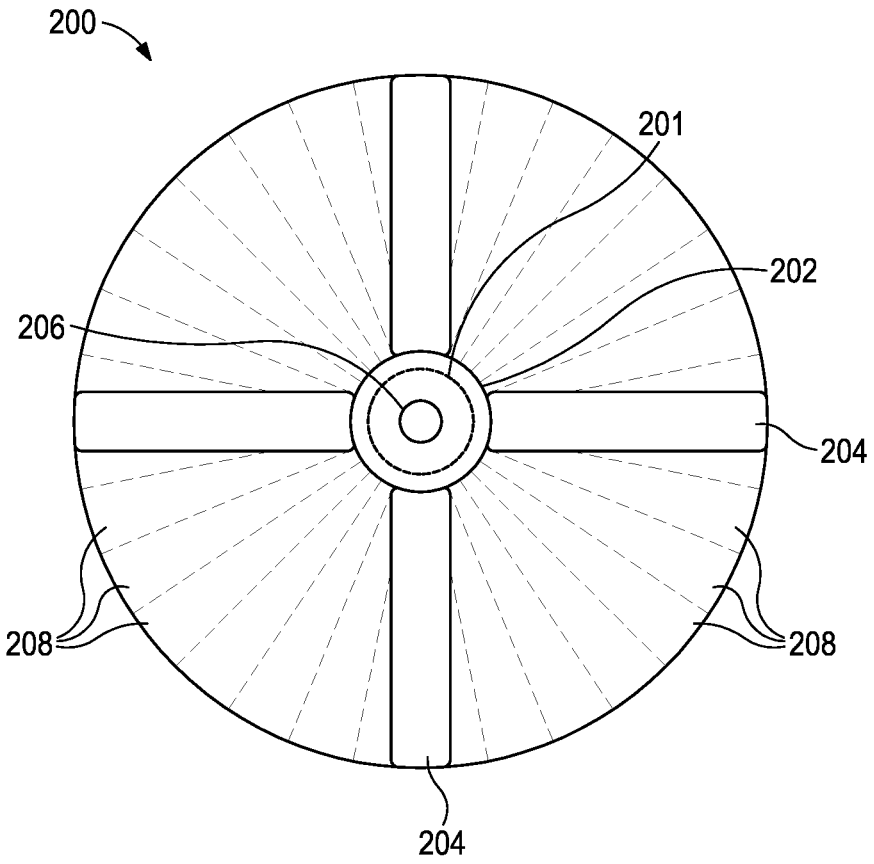
FIG. 2 is a bottom end view of an example expandable retrievable plug, according to at least one embodiment of the present disclosure.

FIG. 2 is a bottom end view of an example expandable retrievable plug 200, according to at least one embodiment of the present disclosure. As described herein, the expandable retrievable plug 200 (hereinafter, "the plug 200") may be conveyable into a wellbore (e.g., the wellbore 102 of FIG. 1) and actuated between a first or "unactuated" state and a second or "actuated" state. The plug 200 is shown in FIG. 2 in the actuated state, or in the process of transitioning to the actuated state. The plug 200 is conveyed into the wellbore in the un-actuated state and, upon reaching a predetermined location within the wellbore, the plug 200 may be actuated to the actuated state, thereby sealing the wellbore and isolating uphole and downhole portions of the wellbore at the plug 200.

In some embodiments, as illustrated, the plug 200 may include a central component or "base" 201 (shown in dashed lines), an inflatable element 202, and a plurality of arm bars 204. The base 201 forms the central component part or element of the plug 200, and the inflatable element 202 and the arm bars 204 may be operatively coupled thereto. More specifically, the inflatable element 202 may be attached to the base 201, and the arm bars 204 may be pivotably attached to the base 201 at corresponding hinges (not shown) and engageable with the inflatable element 202. As described herein, the inflatable element 202 may be inflated (expanded in size), and as the inflatable element 202 inflates, the arm bars 204 may be urged to pivot radially outward based upon the level of inflation of the inflatable element 202.

The plug 200 may further include a pressure vessel 206 in fluid communication with the inflatable element 202. The pressure vessel 206 may be operable and otherwise selectively actuatable to provide (inject) a fluid to the inflatable element 202 to inflate the inflatable element 202. In some embodiments, the pressure vessel 206 may comprise a pneumatic pressure vessel, and the fluid may comprise a compressed gas (e.g., air) that is selectively released into the inflatable element 202. In other embodiments, however, the pressure vessel 206 may comprise a hydraulic pressure vessel, and the fluid may comprise a hydraulic fluid that is selectively pumped into the inflatable element 202 under pressure. As the fluid is injected into the inflatable element 202, the inflatable element 202 inflates and its enlarged size correspondingly engages the arm bars 204, which are urged to pivot radially outward, as described in more detail below. Accordingly, the pressure vessel 206 may be selectively activated downhole to actuate (expand) the inflatable element 202 and thereby expand the arm bars 204.

In some embodiments, the pressure vessel 206 may be time-activated. In such embodiments, the pressure vessel 206 may include (or be in communication with) an internal timer that may be set or programmed prior to deploying the plug 200. Moreover, in such embodiments, the internal timer may be programmed with a predetermined time or duration, which will enable proper positioning of the plug 200 prior to activating the pressure vessel 206 and releasing the gas into the inflatable element 202. In other embodiments, however, the pressure vessel 206 may be in communication with surface equipment (either wired or wirelessly) such that the pressure vessel 206 may be selectively actuated remotely by a well operator when the plug 200 is positioned in the desired location within the wellbore.

The arm bars 204 may be made of a variety of rigid materials. In some embodiments, for example, the arm bars 204 may be formed of a metal, such as cast iron, stainless steel, a steel alloy, or aluminum, which help maintain high yield strengths for high force applications. In other embodiments, however, the arm bars 204 may be made of other rigid materials, such as a high-strength polymer or a composite material, without departing from the scope of the disclosure. While four arm bars 204 are depicted in FIG. 2, more or less than four may be employed in the plug 200, without departing from the scope of the disclosure. Moreover, while the arm bars 204 are depicted as being equidistantly spaced from each other, the arm bars 204 could alternatively be non-equidistantly spaced.

As indicated above, the arm bars 204 may be pivotably attached to the base 201. This allows the arm bars 204 to transition between a first or "stowed" configuration, and a second or "extended" configuration. The arm bars 204 are shown in FIG. 2 in the extended configuration, but are transitionable to the stowed configuration when conveying the plug 200 downhole, or when retrieving the plug 200. To transition the arm bars 204 to the extended configuration, the inflatable element 202 is inflated through actuation of the pressure vessel 206, as generally described above. As the inflatable element 202 inflates, the body of the inflatable element 202 physically engages the arm bars 204 and urges the arm bars 204 to pivot radially outward and to the extended configuration. The arm bars 204 can be transitioned back to the stowed configuration by releasing the pressure within the inflatable element 202 and otherwise deflating the inflatable element 202. In at least one embodiment, the arm bars 204 may be spring-loaded. In such embodiments, releasing the pressure in the inflatable element 202 will allow the spring-loaded arm bars 204 to naturally transition back to the stowed configuration.

The plug 200 further includes a set of expandable blades 208 angularly interposing each pair of angularly adjacent arm bars 204. In some embodiments, each expandable blade 208 may be operatively coupled to and extend radially outward from the base 201. In other embodiments, only some of the expandable blades 208 are operatively coupled to the base 201. In yet other embodiments, the expandable blades 208 may instead be attached to the angularly adjacent arm bars 204, as discussed in more detail below.

The expandable blades 208 in each set angularly overlap each other by at least a small amount, similar to how a Japanese-fan operates. The expandable blades 208 in each set may be movable between a first or "stacked" state, and a second or "fanned" state. When in the stacked state, the expandable blades 208 fully or almost fully overlap each other and are thus "stacked" atop one another. However, when the expandable blades 208 are transitioned to the fanned estate, as shown in FIG. 2, the expandable blades 208 are able to spread out and angularly overlap each other by only a small amount (or not overlap at all).

As illustrated, a set of expandable blades 208 angularly interposes each angularly adjacent pair of arm bars 204. Moreover, the first and last blades 208 in each set are operatively coupled to the angularly adjacent arm bars 204. Accordingly, as the arm bars 204 are transitioned between the stowed and extended configurations, the expandable blades 208 are correspondingly moved between the stacked and fanned states, respectively. During actuation of the plug 200 to the expanded state, the expandable blades 208 may be spread out to form integral sections of the plug 200 between angularly-adjacent arm bars 204.

At least two expandable blades 208 may be included in each set between angularly-adjacent arm bars 204, but the number of expandable blades 208 in each set may vary depending on the application in depending on the size of the expandable blades 208. In some embodiments, the expandable blades 208 may be formed of a similar material as the arm bars 204, which helps to create a full circle of high-yield strength material. In the illustrated embodiment, the plug 200 includes four arm bars 204, with a set of expandable blades 208 interposing each angular-adjacent pair of arm bars 204, and thus creating four quadrants of the plug 200 when expanded. It should be noted, however, that any number of arm bars 204 and corresponding sets of expandable blades 208 to create the plug 200, without departing from the scope of this disclosure.

Figure 3:
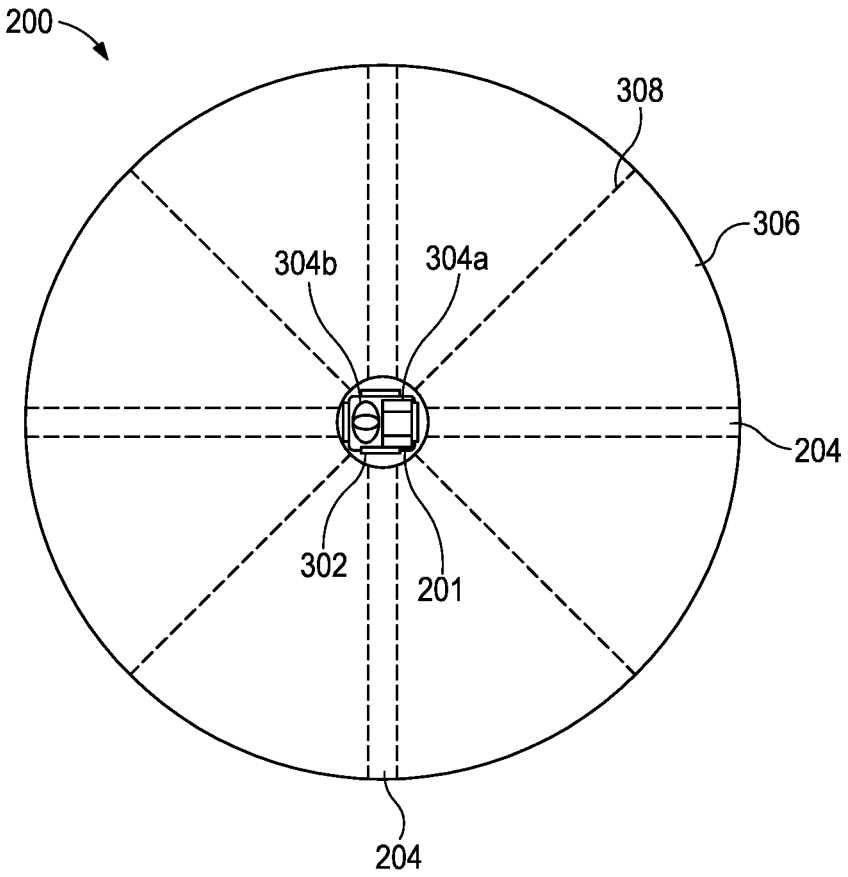
FIG. 3 is a top end view of the expandable retrievable plug of FIG. 2, according to one or more embodiments of the present disclosure.

FIG. 3 is a top end view of the plug 200, according to one or more embodiments of the present disclosure. In FIG. 3, the base 201 is visible, and one or more hinges 302 may be operatively coupled to the base 201. Each hinge 302 may be coupled to a corresponding one of the arm bars 204 (shown in dashed lines), accordingly the number of hinges 302 may be similar to the number of arm bars 204. The hinges 302 impart pivoting ability to the arm bars 204, thereby allowing the arm bars 204 to pivotably transition between the stowed and expanded configurations while remaining anchored to the base 201. The hinges 302 may further connect the arm bars 204 with the adjacent set of expandable blades 208, such that the plug 200 may expand and retract as necessary. Moreover, as briefly mentioned above, one or more of the hinges 302 may be spring-loaded, which allows the arm bars 204 naturally returned to the stowed configuration The base 201 may further include one or more coupling features used to couple the plug 200 to a downhole conveyance, such as wireline, slickline, coiled tubing, a string of drill pipe or production tubing, or any combination thereof. In the illustrated embodiment, the plug 200 includes first and second coupling features 304*a* and 304*b*, alternately referred to as a "setting fish neck" and a "retrieving fish neck," respectively. The coupling features 304*a,b* may be operable to either set the plug 200 within a wellbore or retrieve the plug 200 after operation of the plug 200 is completed.

The first coupling feature 304*a*, for example, may provide a location to attach the plug 200 to a downhole conveyance, thereby enabling the plug 200 to be deployed within a wellbore. Moreover the first coupling feature 304*a* may additionally provide a point of actuation for the plug 200. In some embodiments, for example, the plug 200 may be run downhole on wireline operatively coupled to the first coupling feature 304*a*. After locating the plug 200 within the wellbore at the proper or predetermined location, the first coupling feature 304*a* may be manipulated using the wireline (conveyance) to trigger actuation of the plug 200 and thereby transition the plug 200 to the actuated state. The conveyance may further include slickline, coiled tubing, or drilling pipe, which may be connected with the first coupling feature 304*a* at a surface location. Following the setting of the plug 200, the conveyance may be jarred to free the conveyance from the first coupling feature 304*a* and then run out of the hole.

In contrast, the second coupling feature 304*b* may enable retrieval of the plug 200 after the desired downhole operation has been performed within the wellbore. The second coupling feature 304*b* may provide or otherwise define a coupling structure capable of being located and grasped onto by a conveyance conveyed downhole. The coupling structure may be referred to as a "fish neck," thus characterizing the second coupling feature 304*b* as a "retrieving fish neck". In at least one embodiment, the second coupling feature 304*b* may be operatively coupled to or otherwise include a deflating system designed to deflate the inflatable element 202 (FIG. 2) when latching and pulling of the plug 200 is achieved.

As shown in FIG. 3, the plug 200 may further include an expandable seal 306. The expandable seal 306 may be configured to substantially cover the top end of the plug 200, including covering the arm bars 204 and the sets of expandable blades 208 (FIG. 2). The expandable seal 306 may comprise a pliable or stretchable rubber or elastomeric material capable of generating a sealed interface within a wellbore (or casing lining the wellbore) when the plug 200 transitions to the actuated state.

In some embodiments, the expandable seal 306 may comprise a type of balloon or bladder fitted about the outer circumference of the plug 200 and thereby substantially covering the top end of the plug 200. In such embodiments, as the plug 200 transitions to the actuated state, the expandable seal 306 will correspondingly expand radially outward as the arm bars 204 and the expandable blades 208 (FIG. 2) are transitioned radially outward. In other embodiments, however, the expandable seal 306 may comprise an elastomeric material or substance applied directly to each of the arm bars 204 and the expandable blades 208, such as a coating, an overlay, an overmold, or the like. In such embodiments, as the plug 200 transitions to the actuated state, the elastomeric material coated on the arm bars 204 and the expandable blades 208 may be able to sealingly engage the inner radial wall of the wellbore casing where the plug 200 is deployed. In either scenario, the expandable seal 306 may be able to fold and contract as the plug 200 transitions back to the unactuated state.

Upon actuation, the expandable seal 306 may stretch with the expansion of the expandable blades 208 (FIG. 2) and fill the desired diameter with the expandable seal 306 to form the seal. To reinforce the expandable seal 306 when the plug 200 is in the actuated state, the plug 200 may further include one or more reinforcing arms 308 (shown in dashed lines) extending radially outward from the base 201. The reinforcing arms 308 may be coupled to the base 201, the expandable blades 208, or both, and may be arranged between the expandable blades 208 and the expandable seal 306. The reinforcing arms 308 may be configured to support the expandable blades 208 when transitioned to the fanned state. In some embodiments, the reinforcing arms 308 may be made of a similar material as the arm bars 204 to increase the overall strength of the plug 200 and retain the shape of the expandable seal 306 when the plug 200 transitions to the actuated state. With proper sizing of the arm bars 204, and the additional strength of the reinforcing arms 308, the plug 200 may be sized to any diameter wellbore.

Figure 4:
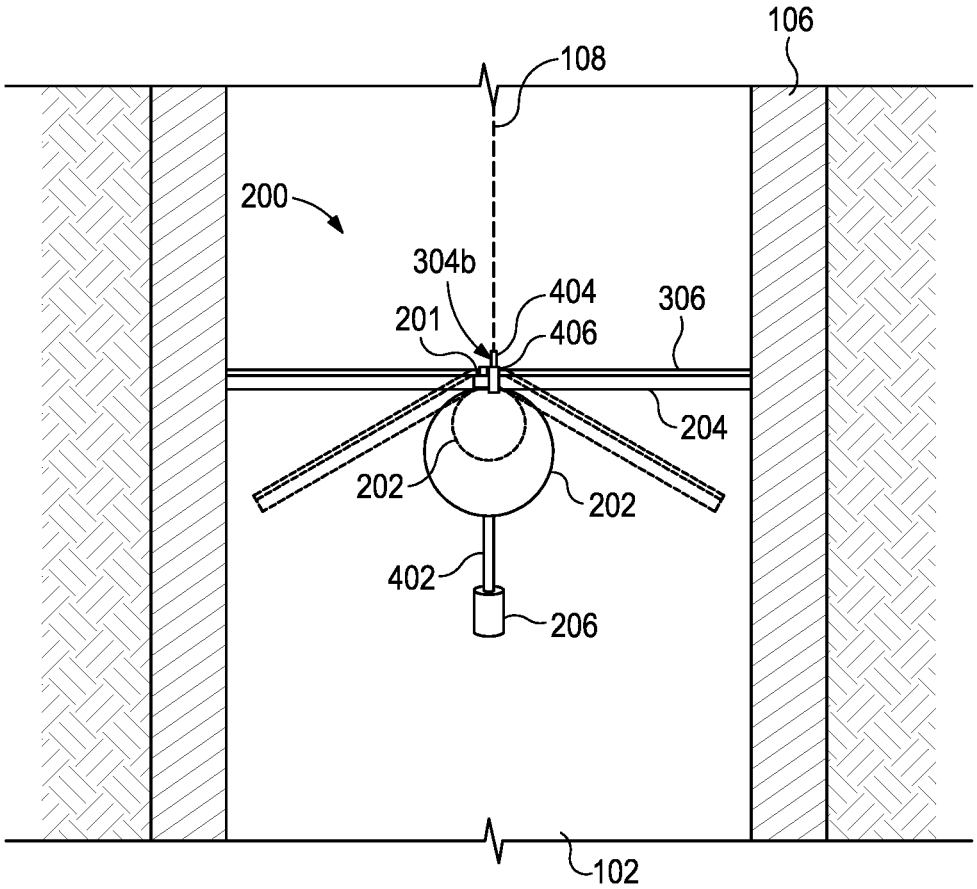
FIG. 4 is a cross-sectional side view of the expandable retrievable plug in both an actuated and unactuated position within a wellbore.

FIG. 4 is a cross-sectional side view of the plug 200 deployed within a wellbore 102, according to one or more embodiments of the present disclosure. More specifically, FIG. 4 depicts the plug 200 in unactuated (dashed lines) and actuated states (solid lines). As depicted, when the plug 200 is in the unactuated state, the inflatable element 202 is deflated and otherwise exhibits a smaller diameter, and the arm bars 204 are allowed to remain in the stowed configuration. With the smaller diameter inflatable element 202, the arm bars 204 and attached expandable seal 306 create a smaller profile of the overall plug 200 such that the plug 200 may be lowered into the wellbore 102 and the casing 106.

Once the plug 200 is located within the wellbore 102 at a predetermined location, the pressure vessel 206 may be activated to transition the plug 200 from the un-actuated state to the actuated state. As briefly mentioned above, the pressure vessel 206 may be actuated and otherwise activated using either a timer or via remote actuation. Once the pressure vessel 206 is activated, the pressurized fluid (e.g., gas or compressible liquid) within the pressure vessel 206 may flow into the inflatable element 202 and thereby transition the inflatable element 202 from a deflated state to an inflated state. In at least one embodiment, as illustrated, the pressure vessel 206 may be fluidly coupled to the inflatable element 202 via a gas tube 402. The gas tube 402 provides a conduit to convey the fluid from the pressure vessel 206 to the inflatable element 202. In other embodiments, however, the gas tube 402 may be omitted and the pressure vessel 206 may instead be directly coupled to (or contained within) the inflatable element 202.

Upon inflating the inflatable element 202, the arm bars 204 may pivot radially outward to the extended state. In the process, the expandable blades 208 (FIG. 2) may transition from the stacked state to the fanned state, while simultaneously stretching the expandable seal 306 to reach the desired diameter of the wellbore 102 or the casing 106.

The illustrated embodiment, the second coupling feature 304*b* mounted to the base 201 may include an eye or "eyelet" 404 that may help a well operator locate and connect to the plug 200 during a fishing operation to locate the plug 200. As illustrated, the conveyance 108 (shown in dashed lines) may be operatively coupled to the second coupling feature 304*b* at the eyelet 404.

In at least one embodiment, the eyelet 404 may be operatively coupled to a valve 406, and the valve 406 may be in fluid communication with the inflatable element 202. Upon connection to the eyelet 404, the conveyance 108 attached to the plug 200 may apply an upward force on the second coupling feature 304*b*, which simultaneously actuates the valve 406 and thereby releases fluid pressure within the inflatable element 202 and otherwise commences its deflation process back to the deflated state. In a further embodiment, a shearable member may hold the valve 406 closed, such that as a jarring force is provided by the conveyance 108, the shearable member may be destroyed and the inflatable element 202 may deflate.

In some embodiments, the pressurized gas discharged from the inflatable element 202 may be released to the wellbore 102. During this process, the inflatable element 202 deflates and otherwise reduces in size. The reduction in size of the inflatable element 202 may allow (cause) the arm bars 204 to unseat from the walls of the wellbore 102 (or the casing 106 that lines the wellbore 102), and 1 transition back toward the stowed configuration, as represented by the dashed lines. Thus, releasing the gas and unseating of the arm bars 204 eliminates the seal within the wellbore 102, and places the plug 200 back to the un-actuated state {e.g., a smaller radial profile) and otherwise in a condition to be removed from the wellbore 102. The conveyance 108 may then be retracted back towards the well surface, and simultaneously drawing the plug 200 uphole as coupled to the second coupling feature 304*b*. Once returned to the well surface, the plug 200 may be prepared to be reused in a subsequent downhole operation. For example, the pressure vessel 206 may be replenished with fluid and the plug 200 may be subsequently redeployed for further use.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. An expandable, retrievable plug comprising, a base;

a plurality of arm bars pivotably attached to the base and movable between stowed and extended configurations;

a set of expandable blades comprising at least two expandable blades and operatively coupled to and angularly interposing each pair of angularly adjacent arm bars such that, as the plurality of arm bars move to the extended configuration, each set of expandable blades transitions from a stacked state to a fanned state;

an inflatable element attached to the base and engageable with the plurality of arm bars; and an expandable seal mounted to the plurality of arm bars and each set of expandable blades, wherein selectively inflating the inflatable element transitions the plurality of arm bars from the stowed configuration to the extended configuration, which transitions each set of expandable blades from the stacked state to the fanned state, and simultaneously radially expands the expandable seal.

2. The plug of claim 1, further comprising a pressure vessel in fluid communication with the inflatable element and operable to selectively provide a fluid to the inflatable element to inflate the inflatable element.

3. The plug of claim 2, wherein the pressure vessel comprise a pneumatic pressure vessel and the fluid comprises a compressed gas.

4. The plug of claim 2, wherein the pressure vessel comprise a hydraulic pressure vessel and the fluid comprises a hydraulic fluid.

5. The plug of claim 2, wherein the pressure vessel is time-activated.

6. The plug of claim 1, wherein expandable blades in each set of expandable blades angularly overlap each other when the set of expandable blades is in the stacked state.

7. The plug of claim 1, further comprising a coupling feature coupled to the base and providing a location to couple the base to a downhole conveyance, wherein manipulation of the coupling feature using the downhole conveyance sets the plug within a wellbore.

8. The plug of claim 1, further comprising a coupling feature coupled to the base and providing a fish neck for a downhole conveyance to locate and grasp onto the coupling feature.

9. The plug of claim 8, wherein pulling on the coupling feature with the downhole conveyance causes the inflatable element to deflate.

10. The plug of claim 1, further comprising one or more reinforcing arms extending radially outward from the base to support each set of expandable blades when transitioned to the fanned state.

11. The plug of claim 1, wherein each set of expandable blades includes at least two expandable blades interposing each pair of arm bars.

12. The plug of claim 11, wherein a first and a last blade of each set of expandable blades are operatively coupled to a first arm bar and a second arm bar of each pair of arm bars, respectively.

13. A method, comprising, conveying a plug into a wellbore on a conveyance, the plug including:

a base;

a plurality of arm bars pivotably attached to the base;

a set of expandable blades comprising at least two expandable blades and operatively coupled to and angularly interposing each pair of angularly adjacent arm bars of the plurality of arm bars;

an inflatable element attached to the base and engageable with the plurality of arm bars; and an expandable seal mounted to the plurality of arm bars and each set of expandable blades, inflating the inflatable element and thereby urging the plurality of arm bars to move from a stowed configuration toward an extended configuration;

transitioning each set of expandable blades from a stacked state to a fanned state as the plurality of arm bars move to the extended configuration;

radially expanding the expandable seal as the plurality of arm bars move to the extended configuration and each set of expandable blades transitions to the fanned state; and sealingly engaging an inner wall of the wellbore with the expandable seal as the expandable seal radially expands.

14. The method of claim 13, wherein the wellbore is lined with casing and wherein sealingly engaging the inner wall of the wellbore comprises sealingly engaging an inner wall of the casing.

15. The method of claim 13, wherein the conveyance is a first conveyance, the method further comprising:

conveying a second conveyance into the wellbore;

locating and attaching to a coupling feature provided on the plug with the second conveyance;

pulling uphole on the plug with the second conveyance and thereby deflating the inflatable element;

disengaging the expandable seal from the inner wall of the wellbore as the inflatable element deflates; and conveying the plug out of the wellbore on the second conveyance.

16. The method of claim 15, further comprising supporting each set of expandable blades when transitioned to the fanned state using one or more reinforcing arms extending radially outward from the base.

17. The method of claim 13, wherein the plug further includes a pressure vessel in fluid communication with the inflatable element, and wherein inflating the inflatable element comprises selectively discharging a fluid from the pressure vessel to the inflatable element and thereby inflating the inflatable element with the fluid.

18. The method of claim 13, wherein transitioning each set of expandable blades from a stacked state to a fanned state includes reducing an angular overlap between each of the expandable blades of the set of expandable blades.

19. An expandable, retrievable bridge plug comprising:

a base;

a plurality of arm bars pivotably attached to the base and movable between stowed and extended configurations;

a set of expandable blades comprising at least two expandable blades and operatively coupled to and angularly interposing each pair of angularly adjacent arm bars such that, as the plurality of arm bars move to the extended configuration, each set of expandable blades transitions from a stacked state to a fanned state; and an expandable seal mounted to the plurality of arm bars and each set of expandable blades, wherein extending the plurality of arm bars from the stowed configuration to the extended configuration transitions each set of expandable blades from the stacked state to the fanned state, and simultaneously radially expands the expandable seal.

20. The plug of claim 19, further wherein retracting the plurality of arm bars from the extended configuration to the stowed configuration transitions each set of expandable blades from the fanned state to the stacked state, and simultaneously radially collapses the expandable seal.

* * * * *